US005084155A

United States Patent [19]

Engwall

[11] Patent Number: 5,084,155

[45] Date of Patent: Jan. 28, 1992

[54] RACKING EQUIPMENT FOR PROCESSING PARTS THROUGH ANODIZING, PAINTING AND THE LIKE

[75] Inventor: Dwight L. Engwall, Wichita, Kans.

[73] Assignee: The Boeing Company, Seattle, Wash.

[21] Appl. No.: 573,863

[22] Filed: Aug. 28, 1990

[51] Int. Cl.[5] ..... C25D 17/06

[52] U.S. Cl. ..... 204/297 W; 204/297 R; 211/41

[58] Field of Search ..... 204/297 W; 211/41, 117; 248/297.5

[56] References Cited

U.S. PATENT DOCUMENTS

| | | | |
|---|---|---|---|
| 1,749,953 | 4/1930 | Lichtman | 204/297 W |
| 3,033,776 | 5/1962 | Rosner | 204/297 W |
| 3,118,545 | 1/1964 | Rosner | 204/297 W |
| 3,176,850 | 4/1965 | Rosner | 204/297 W |
| 3,314,877 | 4/1967 | Novitsky | 204/297 W |
| 3,415,473 | 12/1968 | Ollen | 211/117 |

*Primary Examiner*—John F. Niebling
*Assistant Examiner*—Kishor Mayekar
*Attorney, Agent, or Firm*—Finnegan, Henderson, Farabow, Garrett & Dunner

[57] ABSTRACT

A plurality of mounting clips useful in racking parts for conveyance through multiple processing stations including cleansing baths, anodizing, alodine baths, rinses, painting, and a baking oven. Each mounting clip includes at least one set of article-engaging fingers which receives the edge of an article therebetween and cooperates with at least one additional article-engaging finger on a different mounting clip to grip the article with torsional spring pressure and a spring clamp for adjustably mounting the clip upon a support. In one embodiment, the spring clamp is a separate member, a bar retainer clip, that receives the end of the bar to which the mounting clips are attached.

19 Claims, 4 Drawing Sheets

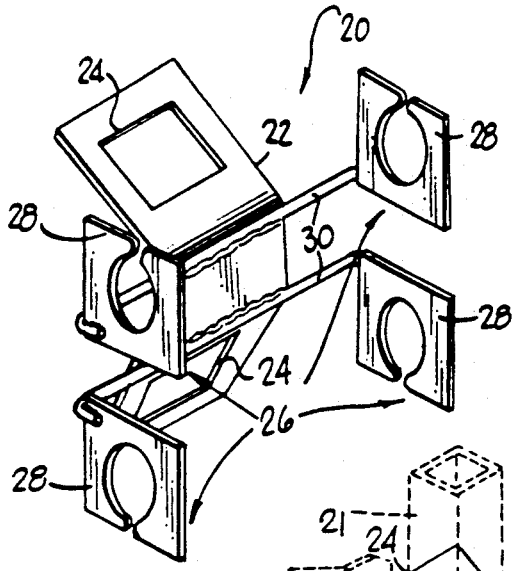
FIG.1
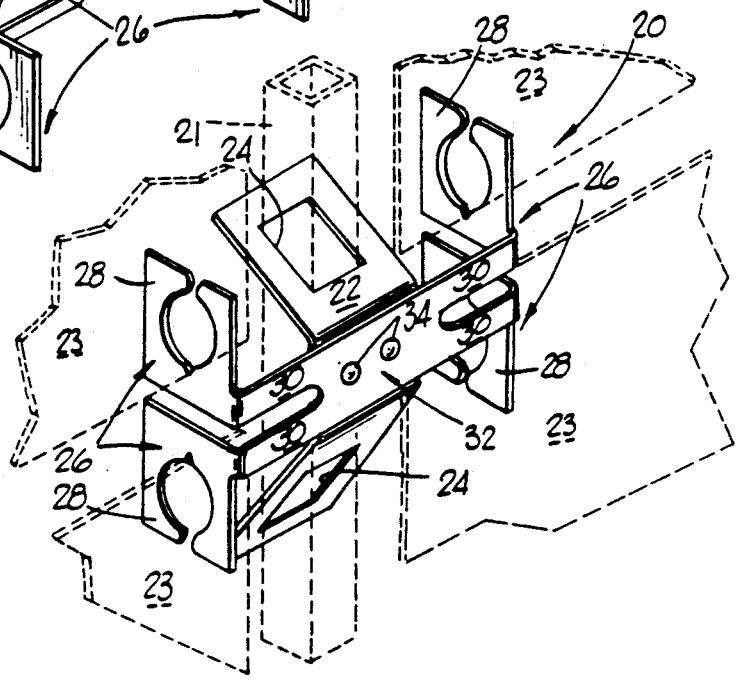
FIG.2
FIG.3
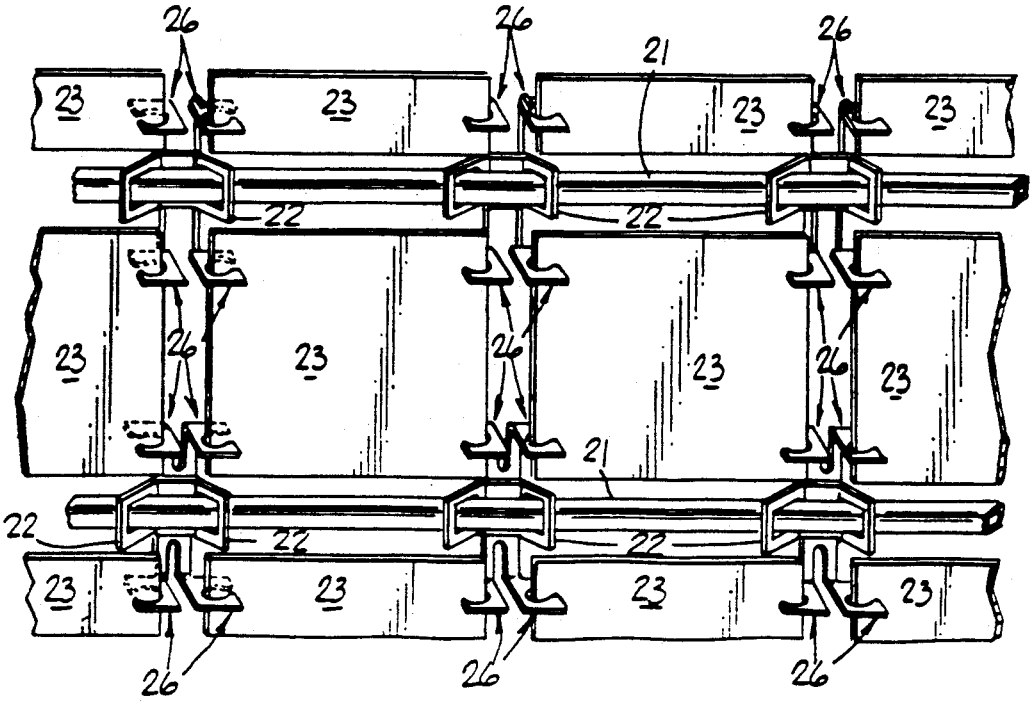
15=

RACKING EQUIPMENT FOR PROCESSING PARTS THROUGH ANODIZING, PAINTING AND THE LIKE

BACKGROUND AND SUMMARY OF THE INVENTION

When processing parts through successive treatment stations such as cleansing baths, anodizing, or alodine baths, rinses, painting chambers and baking ovens, it is common practice to rack and rerack the parts several times for the various sequential operations. Such multiple handling of parts is not cost effective and involves some increased risk for both the parts and the handlers. Furthermore, current practice involves the use of virtually as many different racking clips as there are sizes and shapes of parts. This further adds to the cost and inefficiency of the operation since these many different racking clips must be inventoried and replenished as necessary.

It is the purpose of the racking equipment of the present invention to provide racking clips that provide a system with sufficient flexibility that the different number of racking clips can be significantly reduced. Further, it is the object of this invention to provide a racking system permitting the parts to be racked a single time and conveyed through any number of operations without the need for removal and reracking. To accomplish these objectives, the racking clips must be designed to mask or shadow as little of the parts as possible. Further, parts to be painted must present the two opposing surfaces in such a manner that adjacent parts will not mask or shadow any portion of those opposing surfaces.

Each of the clips of the family disclosed herein comprises a first set of article-engaging fingers for contacting a first edge of an article, and a second set of article-engaging fingers for engaging a second edge of a second article. Some form of spring, preferably a torsional spring, biases at least one set of article-engaging fingers toward another so as to grip the article therebetween. A spring clamp is associated with the article-engaging fingers for movably securing the fingers to a support member which is used to transport articles from station to station. This repositionability feature of the spring clamp provides the system the flexibility necessary to accommodate different sizes and shapes of parts. In each embodiment at least one of either the second set of article-engaging fingers and/or the spring clamp is mounted on a member separate from its corresponding first set of article-engaging fingers.

In a first preferred embodiment of the mounting clips of the present invention, a generally U-shaped first portion has its base secured to the base of a generally V-shaped second portion. The U-shaped first portion has a base which defines a longitudinal axis and can be constructed of rod or sheet stock, although for some applications, particularly those involving salt baths, the rod stock is preferred. In the rod stock embodiment, two U-shaped first portions are used with each mounting clip. The generally V-shaped second portion has a flattened base which defines a longitudinal axis which is perpendicular to the axis of the U-shaped member and is connected to the base of the U-shaped first portion(s). Projecting laterally outwardly from the upturned arm of each U-shaped first portion, as determined relative to the longitudinal axis of the U-shaped portion, is a generally C-shaped set of article-engaging fingers which receive the edge of an article therebetween. The article-engaging fingers on adjacent mounting clips engage opposite edges of the same article. The V-shaped second portions, which form the spring clamps for engaging the support, will be positioned along that support so that the sets of article-engaging fingers are separated by a distance which is less than the pertinent dimension of the article. In this way, the finger sets are each torqued outwardly and grip the article with torsional spring pressure.

In a second preferred embodiment, a first set of article-engaging fingers are interconnected to a second article-engaging member by means of a spring member. This spring member which is preferably a torsional spring, may comprise a coil spring with the coil being affixed as by welding, or the like, to a laterally extending support bar. The lateral support bar may be adjusted relative to the vertical support to vary the size of parts the system can accommodate. In fact, different rows can accommodate parts of different lengths. The first set of article-engaging fingers of a first mounting clip cooperates with a second article-engaging member of a second mounting clip. For standard width articles, a plurality (at least two) pairs of mounting clips will cooperate to secure the article. Each second member including a camming shoulder and a V-shaped notch so the article can be inserted against the pressure of the spring member, camming the second member upwardly until the upper edge of the article engages in and is captured by the V-shaped notch. For narrow articles which are engaged by a single pair of cooperating mounting clips, the second member is modified by a pair of stabilizing fingers adjacent the V-shaped notch opposite the camming shoulder, which engage the back surface of the part and prevent its working loose from the mounting clips.

The ends of the laterally extending support bars may be secured to the vertical supports by a bar retainer clip on each end (and, if necessary, on intermediate supports, as well). The bar retainer clip includes a spring clamp of the same general nature as the first embodiment of mounting clips and one of a variety of shapes of clip members. In one embodiment, the clip member is U-shaped and clamps the bar between the two arms of the U. In another embodiment, the clip member is L-shaped and clasps the bar against the base of the spring clamp. In yet a third embodiment, the clip member captures the end of the lateral support bar between itself and the vertical support member to which it is secured. A stop tab may be provided to any of the three embodiments to prevent the bar from walking upwardly out of the grasp of the retainer clip or becoming skewed as the result of one end moving upwardly relative to the other.

Yet a third preferred family of mounting clips incorporates a V-shaped spring clamp for engaging a support bar and two identical pairs of article-engaging fingers employing C-shaped finger sets welded thereto. In one embodiment, a rod member forms a coil spring for each of two finger sets and is interconnected below the bottom of one arm of the spring clamp with a second such arrangement provided on the opposite spring clamp arm which engages a different article than the first. In a second embodiment of this family of mounting clips, the two sets of fingers are interconnected across the base of the V-shaped clamp rather than across the bottom of each arm.

It is an important aspect of the present invention that the spring clamp means form solid electrical contact with the support upon which it is mounted as well as the article-engaging fingers or members which are affixed to the spring clamp means and that the article-engaging fingers of the present invention have solid electrical contact with the article supported thereby. Both the anodizing process and the painting step require an electrical charge to be transmitted through the carrier support through the mounting clips to the articles being treated.

Various features, advantages, and characteristics of the present invention will become apparent after a reading of the following detailed description.

BRIEF DESCRIPTION OF THE DRAWINGS

FIG. 1 is a perspective view of a first preferred embodiment of the mounting clip of the present invention;

FIG. 2 is a perspective view of a second embodiment of a mounting clip, with supported articles shown in dotted line positions;

FIG. 3 is a bottom view of a pair of parallel lines of mounting clips showing different sizes of articles being engaged;

DETAILED DESCRIPTION OF PREFERRED EMBODIMENTS

Figure 7:
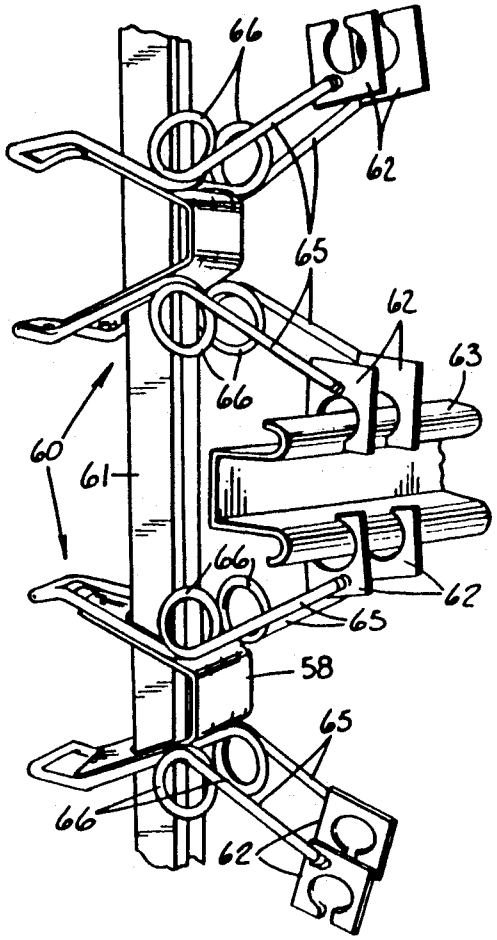
FIG. 7 is a perspective view of a fifth embodiment of the mounting clip that is particularly for usage with elongated articles.

A first preferred embodiment of the mounting clip of the present invention is depicted in FIG. 1, generally at 20. Each mounting clip 20 is comprised of two basic elements: a V-shaped spring clamp means 22 and one or more sets of article-engaging fingers 26. V-shaped spring clamp 22 has a pair of aligned openings 24 which receive a support bar 21 shown in FIG. 2. When pinched together, the arms of the "V" position openings 24 are generally perpendicular to the axis of support bar 21 facilitating repositioning of mounting clip 20 for loading, unloading, increasing, or decreasing the spring pressure exerted upon an article, etc. When the V-shaped arms of spring clamp 22 are released, openings 24 are skewed relative to the axis of support bar 21, frictionally gripping bar 21 and securing mounting clip 20 relative thereto.

Article-engaging fingers 26 are comprised of a C-shaped member 28 that position a finger on each side of the edge of an article 23 as seen in FIG. 2. Article-engaging fingers 26 basically have point contact with the surface of the article 23 so as to minimize the surface area masked during painting or other surface treatment. An arm 30 interconnects article-engaging fingers 26 with spring clamp 22. In the FIG. 1 embodiment, two arms 30 are configured from rod stock in a V-shaped configuration each being tack welded, or the like, to spring clamp 22. In the FIG. 2 embodiment, arms 30 are formed from a single plate member 32 that is spot welded or riveted as at 34 to spring clamp 22. Another distinction is the direction of the turn of the U-shaped member formed by arms 30. For narrower articles, the FIG. 1 configuration is preferred since an article can be supported by the article-engaging fingers 26 of one mounting clip 20 on the top edge and a second set of article-engaging fingers 26 from a second mounting clip 20 engaging the bottom edge. The configuration of the FIG. 2 embodiment is useful for supporting wider articles 23 where engagement in the vicinity of each of the four corners is needed to provide stability.

The determination of whether arms 30 are manufactured from plate or rod material is a function of usage. The plate configuration of FIG. 2 will be satisfactory for many applications for which the mounting clips 20 may be used. However, for certain applications involving chemical salt baths such as anodizing or alodinizing baths, the rod stock embodiment of FIG. 1 is preferred. The chemical salts can become trapped between the double plates of the FIG. 2 embodiment such that even processing the mounting clips through a rinse will not displace them. This could potentially result in corrosion of the mounting clips 20 and a significant reduction in their useful lives.

In use, a first row of mounting clips 20 is positioned upon vertically extending support bars 21. Articles 23 are set into fingers 26. A second row of mounting clips 20 is moved downwardly along support 21 to a position that is separated from the first row by a distance that is less than the length of the supported article 23. In this manner, each arm 30 will be torqued outwardly slightly with a resultant torsional spring pressure being exerted by C-shaped fingers 26 upon articles 23. The articles are effectively clamped between cooperating article-engaging fingers 26, thereby discouraging the articles from working loose as they are transported from station to station for treatment. A second row of articles can then be inserted in the upwardly turned fingers 26, and so on, until the capacity of the support rack is reached.

FIG. 3 depicts the usage of the FIG. 1 embodiment in the upper row and the FIG. 2 embodiment in the lower row. This is shown for illustration purposes only since, typically, variations in usage will dictate that these two embodiments not be used together. Further, the U-shaped arms 30 of the FIG. 1 and FIG. 2 embodiments would necessarily need to be commonly directed in order to permit such usage. The FIG. 2 style clip will typically be used to mount the larger articles 23 as depicted in the center row of FIG. 3.

Figure 6:
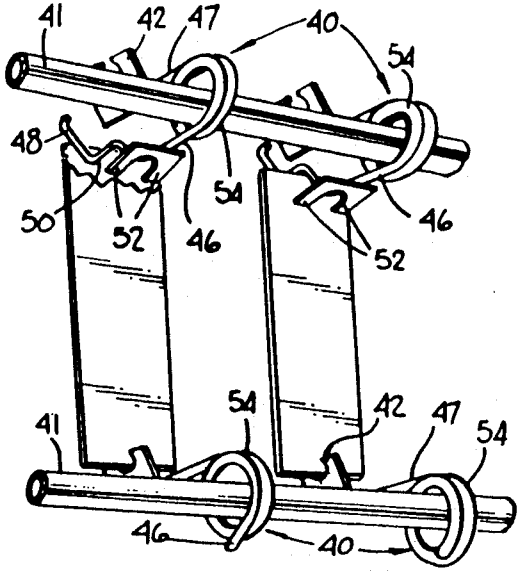
FIG. 6 is a perspective view of yet a fourth embodiment of the mounting clip for use with narrow articles.
Figure 5:
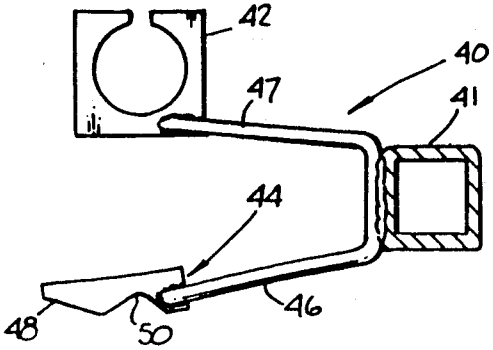
FIG. 5 is a partial cutaway side view of another embodiment, slightly varying from the embodiment of FIG. 4.
Figure 4:
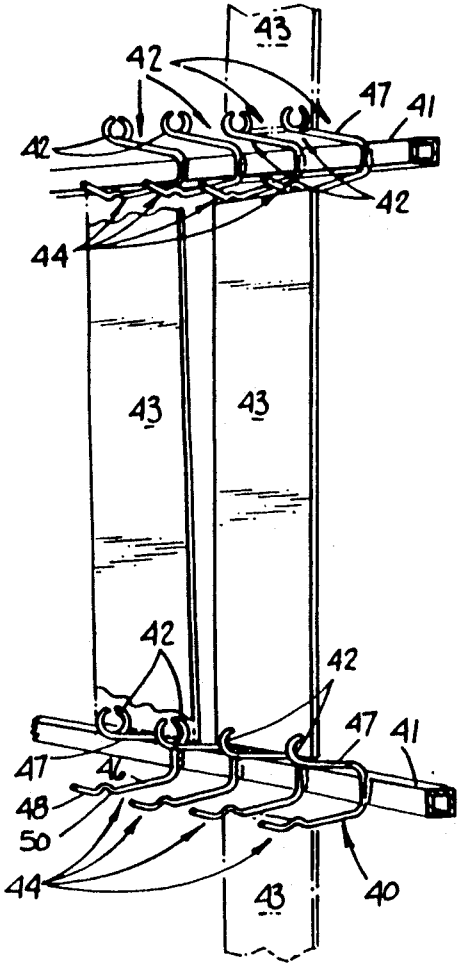
FIG. 4 is a perspective view of a third embodiment of the mounting clip of the present invention employing two different types of article-engaging fingers.

A family of different type of mounting clip is depicted in FIGS. 4-6. Each mounting clip 40 comprises a first set of article-engaging fingers 42 which are again configured as a C-shaped member and a second article-engaging member 44 of a second configuration. Article-engaging member 44 is formed as a spring-biased finger 46, with a camming shoulder 48 and a V-shaped notch 50 into which the upper edge of article 43 is received. Each mounting clip 40 is secured as by welding to a lateral support 41 which can be positioned relative to a vertically extending support (not shown). In use, a first set of mounting clips will be adjusted to position by moving lateral support 41 into place along vertical support (not shown). The lower edge of articles 43 are set into C-shaped fingers 42 and the upper edges are rotated against camming shoulder 48 causing spring-biased finger 46 and spring-finger 47 upon which the first set of article-engaging fingers 42 are mounted to separate, permitting the upper edge of article 43 to be received in V-shaped notch 50. Spring fingers 46 and 47 exert a spring pressure grip upon articles 43.

As shown in FIG. 5, mounting clip 40 may alternatively have C-shaped fingers 42 and the V-shaped notch 50 formed of plate material rather than from rod stock. In the FIGS. 4 and 5 embodiments, a plurality (2, 3, or more) of mounting clips 40 engage the upper and lower edges of each article 43. The FIG. 6 embodiment has been specifically configured for articles which are too narrow for multiple clip engagement. A pair of stabilizing support members 52 are located adjacent V-shaped notch 50. When the upper edge of article 43 is cammed into notch 50, support members 52 engage the back side of the article at two points and prevent these narrow articles from working their way out of clamping fingers 42 and 44. This configuration also increases the flexibility of the spring fingers 46 and 47 by incorporating a coil spring 54. The coils of spring 54 are then welded, preferably along the front portion, to lateral support 41. Coil spring 52 could, obviously, be incorporated into the FIG. 4 embodiment, if desired.

Figure 8:
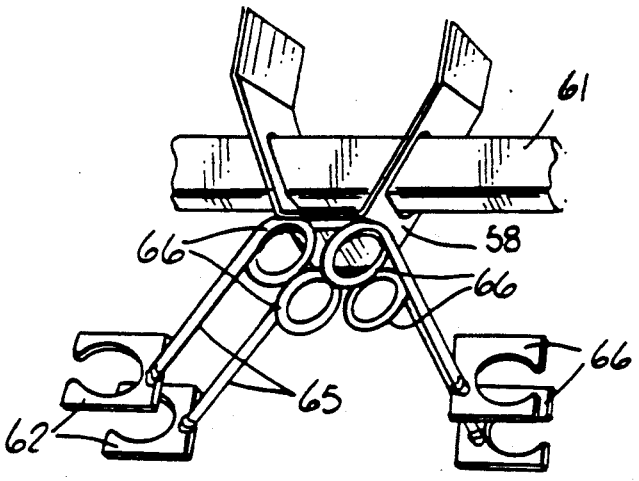
FIG. 8 is an enlarged perspective of a variant mounting clip of the FIG. 7 embodiment.

Still a third family of mounting clips 60 is depicted in FIGS. 7 and 8. Like the first group of clips 20, clips 60 employ an adjustable V-shaped spring clamp 58 to position mounting clips 60 along vertical support 61. In the FIG. 7 embodiment, a rod member 65 extends from a first C-shaped article-engaging finger 62, into the loop of a coil spring 46, along and beyond the outer periphery of spring clamp 58, up the other side of clamp 58, and through the loop of a second coil spring 66 to second article-engaging finger 62. This embodiment can be utilized in a plurality of tandem pairs (only one pair shown) to secure the ends of an elongated channel-shaped article 63. Rod member 65 may be secured to spring clamp 58 by welding, or the like.

In the FIG. 8 embodiment, rod 65 extends across the base of spring clamp 58 rather than along the periphery of the arms of clamp 58. This will afford less resistance to pinching of the arms of the clamp 58 and make adjustment of the position of the spring clamp 58 and its associated mounting clip 60 easier.

As was mentioned with respect to the FIG. 4–6 embodiments, the means for securing the lateral support bar to its vertical support is a separate member. Preferably, that member takes the form of one of the bar retainer clips 80 depicted in FIGS. 9–14.

Figure 9:
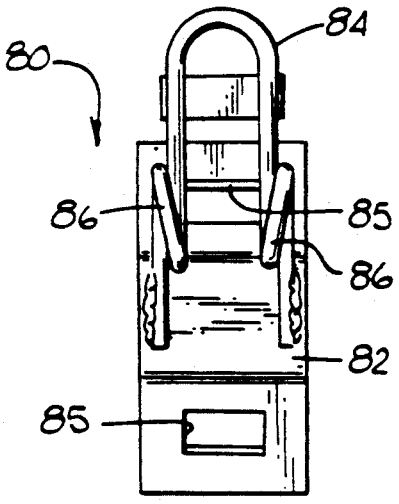
FIG. 9 is a front view of a first embodiment of bar retainer clip of the present invention.
Figure 10:
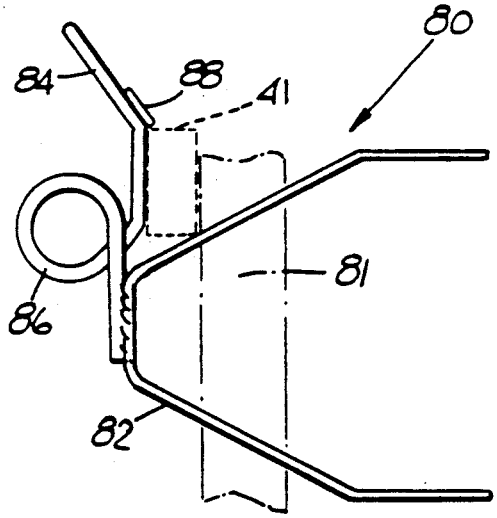
FIG. 10 is a side view of the FIG. 9 embodiment of the bar retainer clip.

The first embodiment is shown in FIGS. 9 and 10. A spring clamp member 82 has a pair of aligned openings 85 which receive vertical support 81. Spring clamp member 82 is identical in configuration and function to spring clamps 22 and 58 of mounting clips 20 and 60, respectively. A clip member 84 is formed of rod stock with coils 86. In this embodiment, the base of clip 84 is attached by welding to the base of V-shaped spring clamp 82. A laterally extending stop tab 88 may extend between the arms of generally U-shaped clip and serve to prevent undesired upward movement of lateral support bar 41. In this embodiment, clip 84 clasps support bar 41 against vertical support 81.

Figure 11:
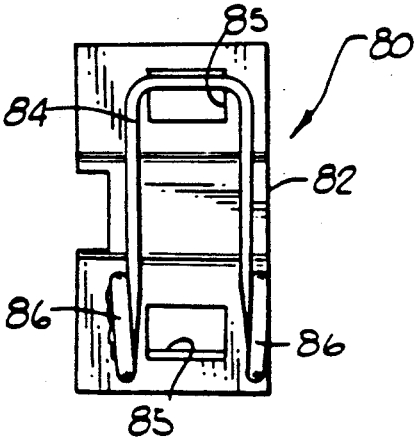
FIG. 11 is a front view of a second embodiment of the bar retainer clip of the present invention.
Figure 12:
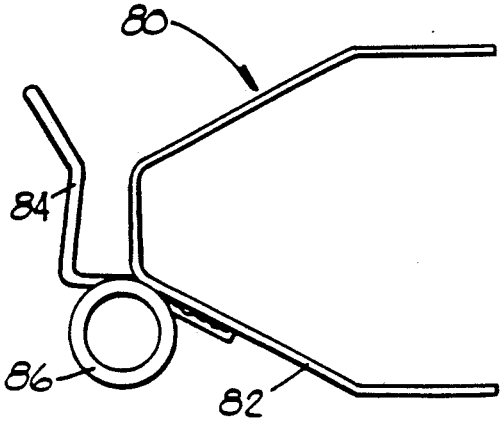
FIG. 12 is a side view of the second embodiment of the bar retainer clip.

In a second embodiment shown in FIGS. 11 and 12, retainer clip 84 is generally L-shaped in profile and clasps a lateral support bar (not shown) against the base of spring clamp 82.

Figure 13:
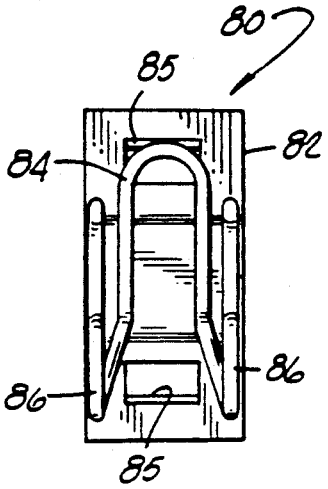
FIG. 13 is a front view of a third embodiment of the bar retainer clip of the present invention.
Figure 14:
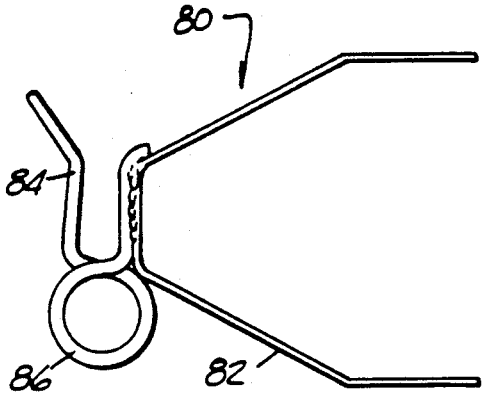
FIG. 14 is a side view of the third embodiment of bar retainer clip.

In yet a third embodiment depicted in FIGS. 13 and 14, clip 84 is generally U-shaped in profile and clasps the vertical support bar (again, not shown) between the two arms of the V-shaped member.

Figure 15:
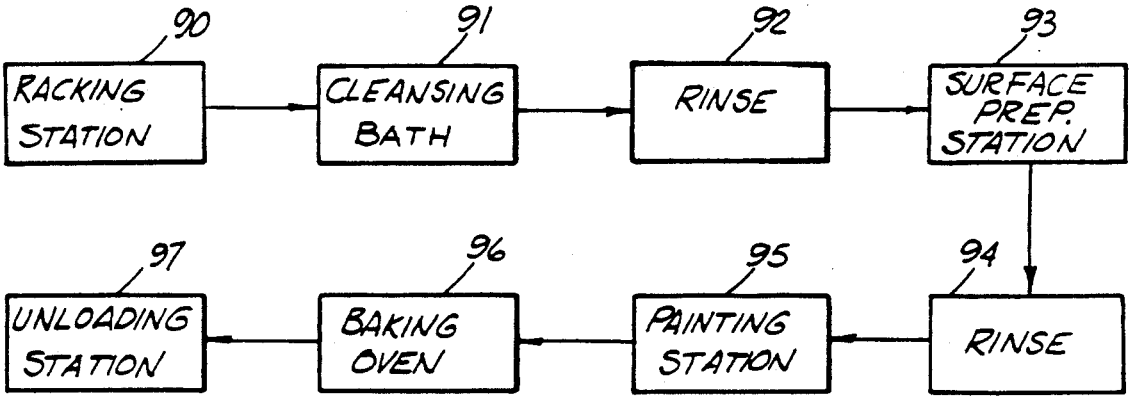
FIG. 15 is a schematic flow chart for treatment of racked parts employing the mounting clips of the present invention.

FIG. 15 diagrammatically depicts the flow of parts from station to station in a multi-operation treatment. Articles are racked upon support racks using the mounting clips 20, 40, 60 and the bar retainer clips 80 as needed. The racks are then moved by means of a conveyor system (not shown) sequentially from racking station 90; through cleansing bath 91, which is preferably an alkaline degreasing bath; through a rinse bath 92 then, to a surface preparation station 93, which can be a phosphoric or chromic anodize or an alodine treatment bath; to a second rinse 94; to a painting station 95; through a baking chamber or oven 96; and finally, to an unloading station 97.

The series of mounting clips of the present invention provides a highly flexible system that can be adjusted to accommodate virtually all different sizes and shapes imaginable and permits the number of different types of mounting clips that need to be stocked to be significantly reduced. Further, by providing a mounting clip that can pass successively from one operation to the next, the need to rack, unrack and rerack a group of parts for sequential operations has been eliminated.

Other changes, alternative, and modifications will become apparent to a person of ordinary skill in the art following a reading of the foregoing detailed description. It is intended that all such changes, alternatives, and modifications as fall within the scope of the appended claims be considered part of the present invention.

What is claimed is:

1. A system for securing a plurality of articles having opposed surface areas for transport through surface treatment stations, the system comprising:

a frame including at least two elongated, spaced, generally parallel support elements, the frame having an axial direction parallel to the support elements;

a plurality of mounting clips, each of said mounting clips being slidably disposed on a respective one of the support elements and including a spring clamp normally in biased engagement with the respective support element;

a pair of axially oppositely-oriented article engaging fingers supported by each of said mounting clips, each finger being spring-biased to a predetermined position relative to a mounting clip and being disposed and shaped to engage a separate one of the plurality of articles so that a minimum of the opposed surfaces areas thereof is contacted; and wherein each of said mounting clips is independently moveable on its respective support element to a selected position to place one finger supported thereby in axial opposition to a finger supported by an adjacent mounting clip on the same support element and in transverse aligned relation to a finger supported by a mounting clip on the other support element for supportingly engaging one of the plurality of articles therebetween.

2. The system of claim 1 wherein the shape of each engaging finger supported by each of said mounting clips is substantially identical.

3. The system of claim 1 wherein the shape of each engaging finger supported by each of said mounting clips is different.

4. The system of claim 1 wherein the shape of at least one engaging finger supported by some of the plurality of mounting clips is different than the shape of at least one engaging finger supported by others of the plurality of mounting clips.

5. The system of claim 1 wherein the plurality of mounting clips are disposed to support a plurality of articles between the support elements in an axially adjacent relationship.

6. The system of claim 5 wherein the plurality of mounting clips are disposed to support articles of different axial dimensions in an axially adjacent relationship.

7. The system of claim 1 wherein each of said mounting clips supports another pair of axially oppositely-oriented engaging fingers, the pairs being disposed in transversely aligned relation on opposite sides of the axis of the respective support element engaged by the mounting clip.

8. The system of claim 7 wherein each engaging finger of the two pair thereof supported by each of said mounting clips is disposed to engage a separate one the plurality of articles.

9. The system of claim 7 wherein the commonly oriented finger of each pair is disposed to engage the same article.

10. The system of claim 7 wherein each of said mounting clips includes a member fixed thereto, the member having opposed ends, and wherein one commonly oriented finger of each pair is fixed to a respective one of the opposed ends.

11. The system of claim 10 wherein the member includes means for biasing each finger to its predetermined position.

12. The system of claim 7 wherein each of said mounting clips includes two members fixed thereto, each member having opposed ends, and wherein one commonly oriented finger of each pair is fixed to a respective one of the opposed ends of a respective one of the members.

13. The system of claim 12 wherein each member includes means for biasing each finger attached thereto to its predetermined position.

14. The system of claim 1 wherein each of said mounting clips comprises a central plate and a pair of opposed clamp plates integrally formed with and normally extending in an axial direction at an acute angle to the central plate, the clamp plates generating a return bias when displaced form their normally extending position, each clamp plate having a hole coaxially aligned with the hole in the other plate and being disposed to coaxially, slidably receive a support element therethrough when the clamp plates are displaced toward each other from their normal position by a manually imposed force and to coaxially, frictionally engage a manually imposed force and to coaxially, frictionally engage a support element disposed therethrough when the force is released.

15. The system of claim 1 wherein the pair of engaging fingers supported by at least one of the mounting clips comprises a bar releasably supported by the at least one mounting clip, the bar transversely extending relative to the support element and including a member fixed to the bar, the member having opposed ends biased to axially-aligned predetermined positions, each opposed end being disposed in opposite orientation and shaped to engage axially adjacent articles.

16. The system of claim 15 wherein the at least one mounting clip includes a spring element fixed thereto and defining a channel for releasably supporting the bar.

17. The system of claim 15 wherein the bar is elongated between opposite ends, the ends being releasably fixed to a respective transversely aligned mounting clip on each support element, the bar including a plurality of transversely spaced members each having opposed ends disposed in opposite orientation and shaped to engage axially adjacent articles.

18. The system of claim 15 wherein each aligned mounting clip includes a spring element fixed thereto and defining a channel for releasably supporting a respective end of the bar.

19. In a frame for supporting in planar array a plurality of articles having opposed surface areas for surface treatment, the frame including at least two axially-extending, transversely- spaced support elements, the improvement comprising:

a plurality of mounting clips disposed in spaced axial relation on each support element, each of said plurality of mounting clips including a central plate and a pair of opposed clamp plates integrally formed with and normally extending in an axial direction at an acute angle to the central plate, the clamp plates generating a return bias when displaced form their normal position, each clamp plate having a hole coaxially aligned with the hole in the other plate and being disposed to coaxially, slidably receive its respective support element therethrough when the clamp plates are displaced toward each other from their normal position by a manually imposed force and to coaxially, frictionally engage the support element disposed therethrough when the force is released;

a member fixed to each of said plurality of mounting clips, the member having opposed ends biased to normal, aligned positions;

finger means integral with each opposed end for engaging an article so that a minimum of the opposed surfaces areas thereof is contacted; and wherein each of said plurality of mounting clips is independently moveable on its respective support element to a position selected to place one finger means in axial opposition to a finger means supported by an axially adjacent mounting clip on the same support element and in transverse aligned relation to a finger means supported by a mounting clip on the other support element for supportingly engaging one of the plurality of articles therebetween.

* * * * *